US010410784B2

(12) United States Patent
Ikeda et al.

(10) Patent No.: US 10,410,784 B2
(45) Date of Patent: Sep. 10, 2019

(54) MAGNETIC COMPONENT

(71) Applicant: SHINDENGEN ELECTRIC MANUFACTURING CO., LTD., Tokyo (JP)

(72) Inventors: Kosuke Ikeda, Hanno (JP); Yoshiaki Hiruma, Hanno (JP)

(73) Assignee: SHINDENGEN ELECTRIC MANUFACTURING CO., LTD., Tokyo (JP)

( * ) Notice: Subject to any disclaimer, the term of this patent is extended or adjusted under 35 U.S.C. 154(b) by 199 days.

(21) Appl. No.: 15/510,995

(22) PCT Filed: May 31, 2016

(86) PCT No.: PCT/JP2016/065987
§ 371 (c)(1),
(2) Date: Mar. 13, 2017

(87) PCT Pub. No.: WO2017/208333
PCT Pub. Date: Dec. 7, 2017

(65) Prior Publication Data

US 2018/0166207 A1 Jun. 14, 2018

(51) Int. Cl.
*H01F 27/24* (2006.01)
*H01F 27/08* (2006.01)
(Continued)

(52) U.S. Cl.
CPC ..... *H01F 27/323* (2013.01); *H01F 27/22* (2013.01); *H01F 27/24* (2013.01); *H01F 30/10* (2013.01)

(58) Field of Classification Search
CPC ..... H01F 27/22; H01F 27/2876; H01F 2027/2809; H01F 27/323; H01F 27/324
(Continued)

(56) References Cited

U.S. PATENT DOCUMENTS 6,566,879 B1 * 5/2003 Vanek ..... G01R 33/3852 324/318
7,289,329 B2 * 10/2007 Chen ..... H01F 27/2804 165/185
(Continued)

FOREIGN PATENT DOCUMENTS

CN 1666303 A 9/2005
EP 1530223 A1 5/2005
(Continued)

OTHER PUBLICATIONS

Search Report and Opinion from Netherlands Patent Application No. 2018999 dated Mar. 1, 2018.
(Continued)

*Primary Examiner* — Alexander Talpalatski
*Assistant Examiner* — Joselito Baisa
(74) *Attorney, Agent, or Firm* — Ladas & Parry, LLP

(57) ABSTRACT

A magnetic component has a core 80 provided with a leg 81; and a coil structure having a coil 10, 20 including conductors wrapped around the leg 81, and two or more radiative insulating sheets 100 provided between the conductors; a radiator 91, 92 brought into contact with an end surface of the core 80, and extending toward the radiative insulating sheets 100 and brought into contact with the surface of the radiative insulating sheets 100.

5 Claims, 28 Drawing Sheets

(51) Int. Cl.
*H01F 27/32* (2006.01)
*H01F 30/10* (2006.01)
*H01F 27/22* (2006.01)

(58) Field of Classification Search
USPC ..... 336/219, 61
See application file for complete search history.

(56) References Cited

U.S. PATENT DOCUMENTS

| | | | | |
|---|---|---|---|---|
| 8,164,406 | B2 * | 4/2012 | Lin | H01F 27/2866 336/232 |
| 8,334,747 | B2 * | 12/2012 | Matsumoto | H01F 27/22 336/200 |
| 2003/0128521 | A1 * | 7/2003 | Matayabas, Jr. | H01L 23/3737 361/705 |
| 2004/0032313 | A1 | 2/2004 | Ferencz | |
| 2005/0270745 | A1 * | 12/2005 | Chen | H01F 27/2804 361/707 |
| 2009/0243781 | A1 | 10/2009 | Nomura et al. | |
| 2015/0294782 | A1 | 10/2015 | Moiseev | |
| 2016/0035481 | A1 | 2/2016 | Hachiya | |
| 2017/0025860 | A1 * | 1/2017 | Forbes, Jr. | G06F 1/266 |
| 2017/0338025 | A1 * | 11/2017 | Benzerrouk | H01F 27/22 |

FOREIGN PATENT DOCUMENTS

| | | | |
|---|---|---|---|
| JP | 2001118728 | A | 4/2001 |
| JP | 2009246363 | A | 10/2009 |
| JP | 2012124401 | A * | 6/2012 |
| JP | 2013-062355 | | 4/2013 |
| JP | 2014056868 | A | 3/2014 |
| JP | 2014192517 | A | 10/2014 |
| JP | 2015198181 | A | 11/2015 |
| WO | 2016079903 | A1 | 5/2016 |

OTHER PUBLICATIONS

English translation from WIPO of PCT International Search Report for PCT/JP2016/065987 dated Aug. 30, 2016.
PCT Written Opinion for PCT/JP2016/065987 dated Aug. 30, 2016 with machine English translation (OCR by Adobe Acrobat, Google Translate).
From PCT/JP2016/065985, Written Opinion of International Searching Authority, dated Aug. 30, 2016, with English translation from WIPO.
From PCT/JP2016/065985, International Preliminary Report on Patentability, dated Dec. 4, 2018, with English translation from WIPO.
From PCT/JP2016/065987, International Search Report, dated Aug. 30, 2016, with English translation from WIPO.
From PCT/JP2016/065987, Written Opinion of International Searching Authority, dated Aug. 30, 2016, with English translation from WIPO.
From PCT/JP2016/065987, International Preliminary Report on Patentability, dated Dec. 4, 2018, with English translation from WIPO.
From CN201680003068.2A, Office Action, dated Oct. 9, 2018, with English translation from Google Translate.
U.S. Appl. No. 15/511,997, filed Mar. 13, 2017, Kosuke Ikeda.
International Search Report for PCT/JP2016/065987 dated Aug. 30, 2016 and its English machine translation from Bing Translator.
International Search Report for related PCT/JP2016/065985 dated Aug. 30, 2016 and its English machine translation by Google translate.

* cited by examiner

MAGNETIC COMPONENT

CROSS-REFERENCE TO RELATED APPLICATION

The present application is the U.S. national phase of PCT Application PCT/JP2016/065987 filed on May 31, 2016, the disclosure of which is incorporated herein by reference in its entirety.

TECHNICAL FIELD

The present invention relates to a magnetic component such as a transformer, inductance, and choke coil.

BACKGROUND ART

A magnetic component such as a transformer and choke coil used in a magnetic component has been known in the related arts. A known example of such a transformer has one that laminates a plurality of coil substrates, each of which are insulated from each other by an insulating sheet. A related art disclosed in JP 2014-56868 A is one provided with an insulating sheets between a first printed coil substrate and a second printed coil substrate. In a proposal disclosed in JP 2014-56868 A, a conductor including a metal such as copper (Cu) is buried, in place of the insulating sheet, inside a substrate including an insulating member such as resin having electric insulation properties.

SUMMARY OF INVENTION

Technical Problem

A transformer known in the related arts does not have a sufficient effect of radiating generated heat, especially when using an insulating sheet or insulating member.

The present invention has been made in light of such a situation and the present invention provides a magnetic component capable of achieving high radiation effect.

Solution to Problem

A magnetic component, according to the present invention, comprises:

a core provided with a leg;

a coil structure having a coil including conductors wrapped around the leg, and two or more radiative insulating sheets provided between the conductors; and a radiator brought into contact with an end surface of the core, and extending toward the radiative insulating sheets and brought into contact with the surface of the radiative insulating sheets.

In the magnetic component according to the present invention, the two or more radiative insulating sheets may have a first radiative insulating sheet, and a second radiative insulating sheet having an area in a surface direction larger than an area of the first radiative insulating sheet, the first radiative insulating sheet may be disposed in a position closer to the radiator than the second radiative insulating sheet, and the radiator may be brought into contact with the surfaces of the first radiative insulating sheet and the second radiative insulating sheet.

In the magnetic component according to the present invention, three or more radiative insulating sheets may be provided, the three or more radiative insulating sheets may have a first radiative insulating sheet, a second radiative insulating sheet having an area in a surface direction larger than an area of the first radiative insulating sheet, and a third radiative insulating sheet having an area in the surface direction larger than the area of the second radiative insulating sheet, the first radiative insulating sheet may be disposed in a position closer to the radiator than the second radiative insulating sheet the second radiative insulating sheet may be disposed in a position closer to the radiator than the third radiative insulating sheet, and the radiator may be brought into contact with the surfaces of the first radiative insulating sheet, the second radiative insulating sheet and the third radiative insulating sheet.

In the magnetic component according to the present invention, the two or more radiative insulating sheets may have a low conductivity insulating sheet and a high conductivity insulating sheet, whose conductivity is higher than conductivity of the low conductivity insulating sheet, and at least a surface of the high conductivity insulating sheet may be brought into contact with the radiator.

In the magnetic component according to the present invention, the radiator may have a first radiator brought into contact with a first end surface of the core and a second radiator brought into contact with a second end surface of the core, the first radiator may extend toward the radiative insulating sheet and may be brought into contact with a surface of a first radiator side of the radiative insulating sheets, and the second radiator may extend toward the radiative insulating sheet and may be brought into contact with a surface of a second radiator side of the radiative insulating sheet.

In the magnetic component according to the present invention the coil structure may have a first coil structure and a second coil structure provided separately from the first coil structure, each of the first coil structure and the second coil structure may have the coil and two or more radiative insulating sheets, the radiator may have a first radiator brought into contact with a first end surface of the core and a second radiator brought into contact with a second end surface of the core, the first radiator may extend toward the radiative insulating sheet of the first coil structure and is brought into contact with a surface of a first radiator side of this radiative insulating sheets, and the second radiator may extend toward the radiative insulating sheet of the second coil structure and may be brought into contact with a surface of a second radiator side of this radiative insulating sheet.

Advantageous Effects of Invention

According to the present invention, the radiator extending toward the radiative insulating sheet is brought into contact with the surface of the radiative insulating sheet. As a result, it is possible to achieve high radiation effect.

DESCRIPTION OF EMBODIMENTS

First Embodiment (Configuration)

Figure 1:
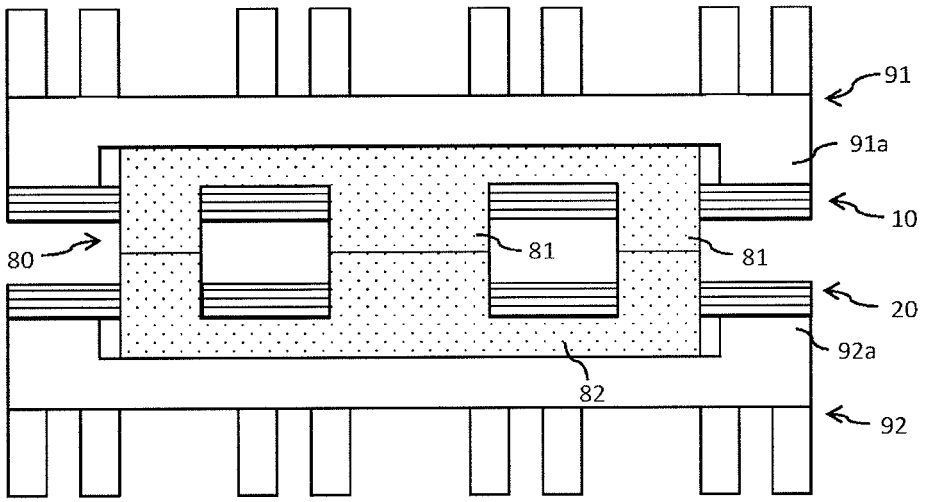
FIG. 1 is a cross sectional side view of a magnetic component according to a first embodiment of the present invention.

As illustrated in FIG. 1, a magnetic component according to the present embodiment has a core 80 provided with a body 82 and legs 81, and a coil structure wrapped around the legs 81. Examples of the magnetic component have a transformer, inductance and choke coil etc. In the present embodiment, a transformer will be hereinafter described as magnetic component, but it should not be restricted thereto.

As illustrated in FIG. 2 to FIG. 21, a coil structure according to the present embodiment has a coil 150 including conductors such as copper and two or more radiative insulating sheets 100 provided between the conductors included in the coil 150. The two or more radiative insulating sheets 100 may also have two or more types of radiative insulating sheets 100 having at least different thermal conductivity or different permittivity, which will be mentioned later. The coil 150 is wrapped along an axial line (imaginary straight line), and surfaces of the radiative insulating sheets 100 are provided with through-holes (not illustrated) so that the wrapped coil 150 passes therethrough.

As illustrated in FIG. 1, the transformer according to the present embodiment has the primary coil 10 and secondary coil 20. Each of the primary coil 10 and secondary coil 20 is wrapped around the legs 81 of the core 80. In the aspect illustrated in FIG. 1, two primary coils 10 and two secondary coils 20 are provided, but the present embodiment should not be restricted to such an aspect. The present embodiment may also apply an aspect in which one primary coil 10 and one secondary coil 20 are provided or an aspect in which three or more primary coils 10 and three or more secondary coils 20 are provided.

A magnetic component according to the present embodiment has radiators 91, 92 such as radiating fins brought into contact with end surfaces of a core 80. The radiators 91, 92 extending toward the radiative insulating sheets are brought into contact with the surfaces of the radiative insulating sheets.

In an aspect illustrated in FIG. 1, the radiators 91, 92 have a first radiator 91 brought into contact with a first end surface of the core 80 (an end surface in an upper part of FIG. 1) and a second radiator 92 brought into contact with a second end surface of the core 80 (an end surface in the lower part of FIG. 1). The first radiator 91 has a first projection part 91*a* (which will be mentioned later). The first projection part 91*a* extending toward the radiative insulating sheets 100 is brought into contact with a surface of a first radiator side of the radiative insulating sheets 100. The second radiator 92 has a second projection part 92*a* (which will be mentioned later). The second projection part 92*a* extending toward the radiative insulating sheets 100 is brought into contact with a surface of a second radiator 92 side of the radiative insulating sheets 100.

The coil structure has a first coil structure and a second coil structure provided separately from the first coil structure. Each of the first coil structure and second coil structure has the coil and two or more radiative insulating sheets. In the aspect illustrated in FIG. 1, the first coil structure is included in a primary coil 10, and the second coil structure is included in a secondary coil 20.

The radiators 91, 92 are brought into contact with surfaces of a body 82 and have the projection parts 91*a*, 92*a* extending toward the surfaces of the radiative insulating sheets 100 in peripheral parts of the radiators 91, 92. FIG. 1 illustrates a cross sectional view of the projection parts 91*a*, 92*a*, but it should be noted that the projection parts 91*a*, 92*a* may be provided intermittently or continuously so as to surround a peripheral of the core 80. More specifically, the first radiator 91 has the first projection part 91*a* extending toward the radiative insulating sheets 100 of the first coil structure (primary coil) 10 and brought into contact with the surface of the first radiator 91 side of the radiative insulating sheets 100. Similarly, the second radiator 92 has the second projection part 92*a* extending toward the radiative insulating sheets 100 of the second coil structure (secondary coil) 20 and brought into contact with the surface of the second radiator 92 side of the radiative insulating sheets 100. FIG. 1 illustrates the cross sectional view of the first projection part 91*a*, but it should be noted that the first projection part 91*a* may be provided intermittently or continuously so as to surround the peripheral of the core 80. Furthermore, the second projection part 92*a* may be provided intermittently or continuously so as to surround the peripheral of the core 80.

Figure 28:
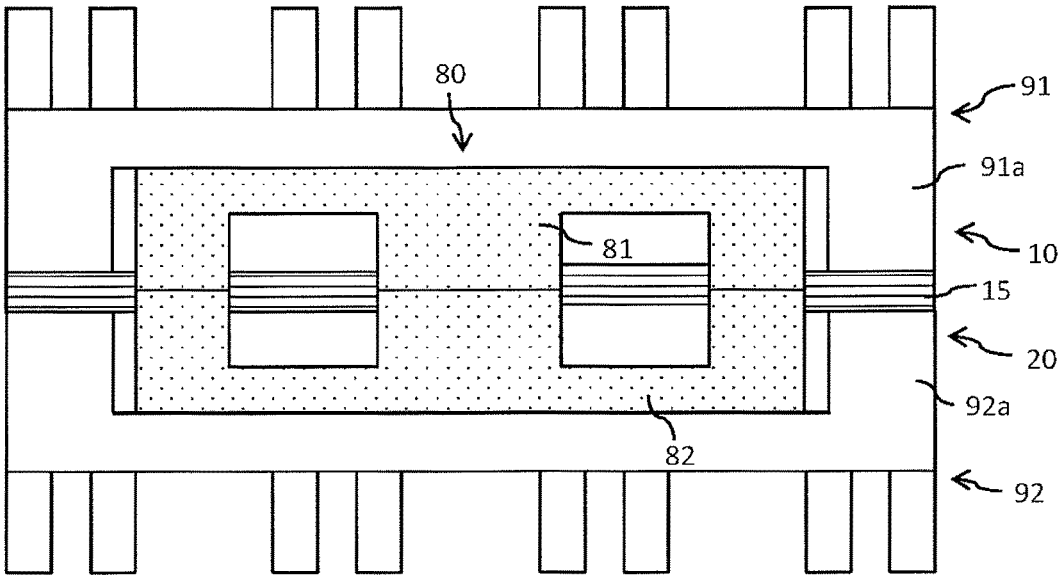
FIG. 28 is a cross sectional side view illustrating another example of the magnetic component applicable to the embodiment of the present invention.

The present embodiment should not be restricted to the aspect illustrated in FIG. 1. As illustrated in FIG. 28, the first projection part 91*a* may be brought into contact with a surface of a first radiator 91 side of radiative insulating sheets 100 included in one coil structure 15 and the second projection part 92*a* may be brought into contact with a surface of a second radiator 92 side of the radiative insulating sheet 100 included in the coil structure 15.

In regard to the two or more radiative insulating sheets 100, all of them may have a sheet having similar properties. It should not be restricted to such a configuration and the two or more radiative insulating sheets 100 may have low thermal conductivity insulating sheets 120, and high thermal conductivity insulating sheets, whose thermal conductivity is higher than that of the low thermal conductivity insulating sheets 120. Furthermore, the two or more radiative insulating sheets 100 may also have low permittivity insulating sheets 130, and high permittivity insulating sheets 140, whose permittivity is higher than that of the low permittivity insulating sheets 130.

Unless otherwise specified, the primary coil 10 and secondary coil 20 will be hereinafter described without being distinguished.

It should be noted that each of the high thermal conductivity insulating sheets 110 has fillers. Due to the fillers, the insulating sheets 110 may be configured to have the thermal conductivity higher than that of the low thermal conductivity insulating sheets 120. Furthermore, each of the high thermal conductivity insulating sheets 110 and low thermal conductivity insulating sheets 120 may have fillers. Due to, for example, different properties, orientations, contents of the fillers, the high thermal conductivity insulating sheets 110 may be configured to have the thermal conductivity higher than that of the low thermal conductivity insulating sheets 120. Each low permittivity insulating sheet 130 has fillers. Due to the fillers, the insulating sheets 130 may be configured to have the permittivity lower than that of the high permittivity insulating sheets 140. Furthermore, each of the low permittivity insulating sheets 130 and high permittivity insulating sheets 140 may have fillers. Due to, for example, different properties and contents of the fillers, the low permittivity insulating sheets 130 may configured to have thermal permittivity lower than the permittivity of the high permittivity insulating sheets 140.

In general, in a case of using fillers including ceramic such as boron nitride and silicon nitride or ceramic-like materials, it is possible to enhance permittivity as well as thermal conductivity. On the other hand, in a case of using fillers including silicon, acryl, and the like, it is possible to lower the permittivity as well as the thermal conductivity. Furthermore, in a case of using fillers including metallic materials, it is possible to enhance the thermal conductivity and to lower the permittivity.

In a case where three or more insulating sheets 100 are provided, the number of the high thermal conductivity insulating sheets 110 may be larger than that of the low thermal conductivity insulating sheets 120. However, the number of those insulating sheets should not be restricted and the number of the low thermal conductivity insulating sheets 120 may be larger than that of the high thermal conductivity insulating sheets 110.

The thermal conductivity of the high thermal conductivity insulating sheets 110 may be twice or more than twice as large as that of the low thermal conductivity insulating sheets 120. Alternatively, the thermal conductivity of the insulating sheets 110 may be further larger, for example, ten times or more than ten times as large as that of the low thermal conductivity insulating sheets 120.

Figure 2:
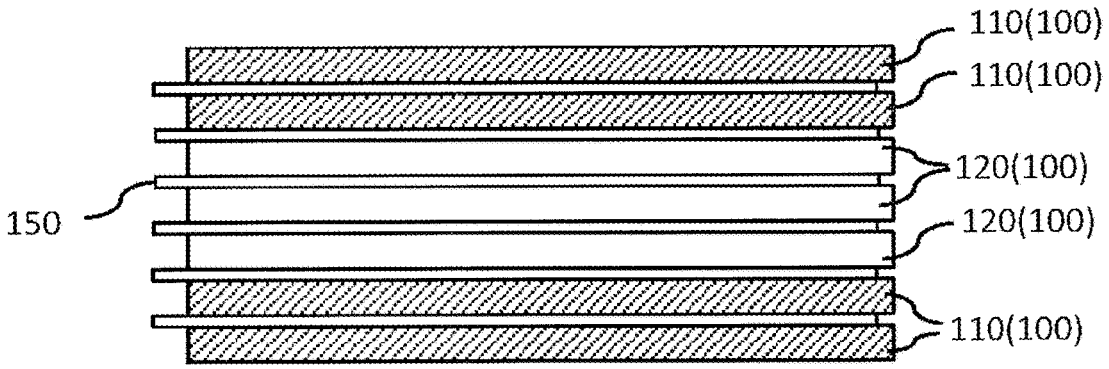
FIG. 2 is a cross sectional side view illustrating an aspect 1 of a coil structure applicable to the first embodiment of the present invention.
Figure 3:
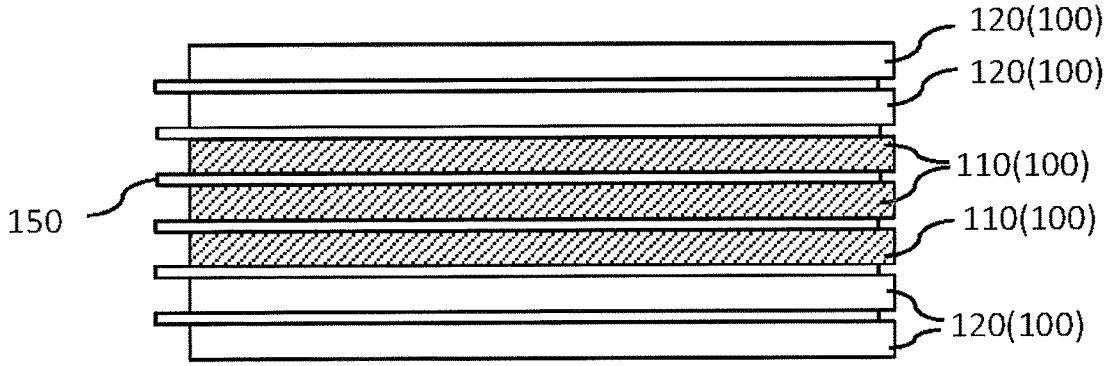
FIG. 3 is a cross sectional side view illustrating an aspect 2 of the coil structure applicable to the first embodiment of the present invention.
Figure 4:
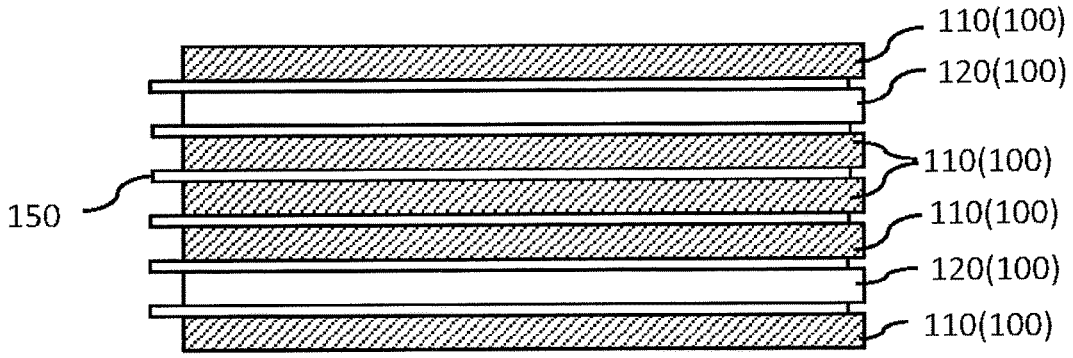
FIG. 4 is a cross sectional side view illustrating an aspect 3 of the coil structure applicable to the first embodiment of the present invention.
Figure 5:
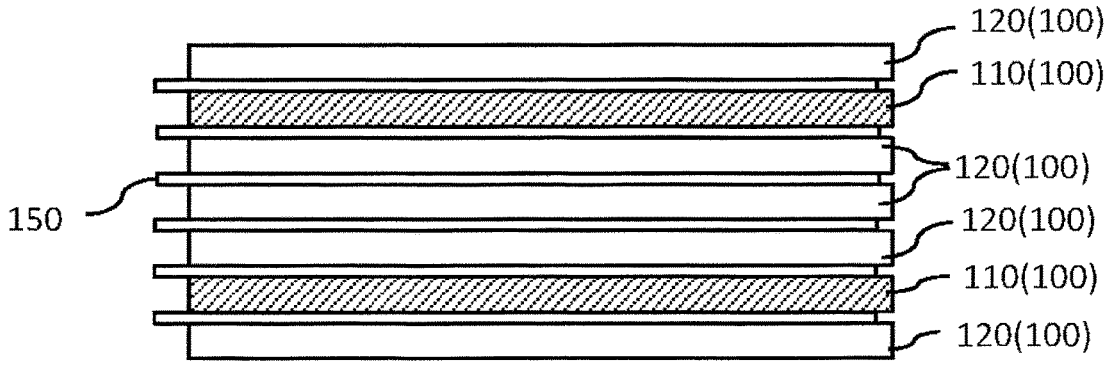
FIG. 5 is a cross sectional side view illustrating an aspect 4 of the coil structure applicable to the first embodiment of the present invention.
Figure 6:
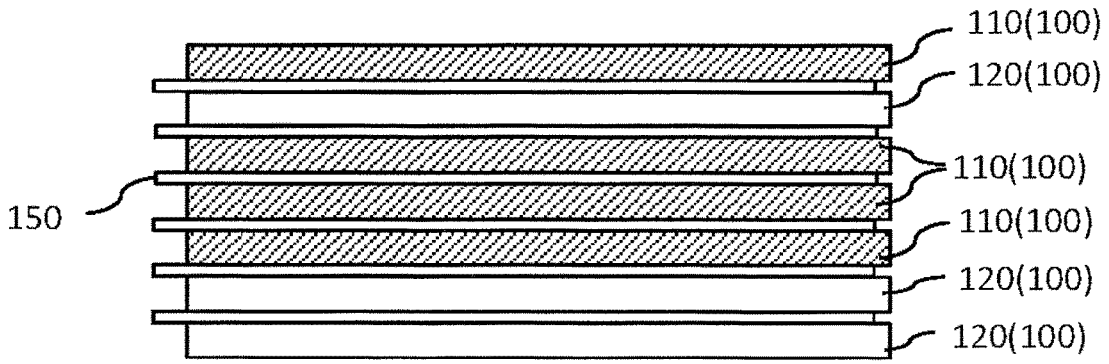
FIG. 6 is a cross sectional side view illustrating an aspect 5 of the coil structure applicable to the first embodiment of the present invention.
Figure 7:
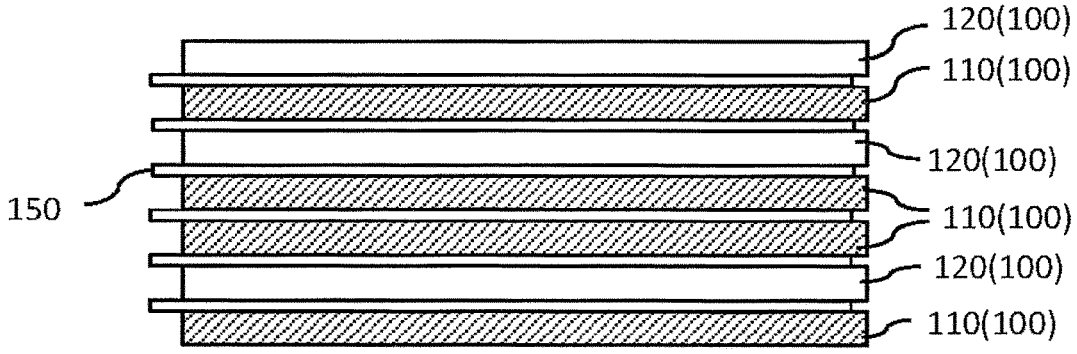
FIG. 7 is a cross sectional side view illustrating an aspect 6 of the coil structure applicable to the first embodiment of the present invention.

As illustrated in FIG. 2 and FIG. 4, the high thermal conductivity insulating sheets 110 may be disposed in outermost surfaces of both ends of a plurality of insulating sheets 100. However, the configuration should not be restricted to such an aspect and the low thermal conductivity insulating sheets 120 may be disposed in the outermost surfaces of the both ends of the plurality of insulating sheets 100 as illustrated in FIG. 3 and FIG. 5. Furthermore, as illustrated in FIG. 6 and FIG. 7, the high thermal conductivity insulating sheets 110 and low thermal conductivity insulating sheets 120 may not be disposed symmetrically with respect to a surface perpendicular to the axial line of the coil 150. For example, a high thermal conductivity insulating sheet 110 may be disposed in an outermost surface of a body 82 side of the core 80, while a low thermal conductivity insulating sheet 120 may be disposed in an outermost surface of an opposing side of the body 82 of the core 80. Alternatively, a low thermal conductivity insulating sheet 120 may be disposed in the outermost surface of the body 82 side of the core 80, while a high thermal conductivity insulating sheet 110 may be disposed in the outermost surface of the opposing side of the body 82 of the core 80.

As illustrated in FIG. 3, FIG. 4, FIG. 6, and FIG. 7, the high thermal conductivity insulating sheets 110 may also be disposed in a middle part in a thickness direction of the three or more insulating sheets 100. The middle part herein represents a substantially half position in regard to the number of the three or more insulating sheets 100. For example, when the number of the plurality of insulating sheets 100 is even ($n_0$ pieces), $n_0/2$ or $n_0/2+1$ will be the middle part. Alternatively, when the number of the plurality of insulating sheets 100 is odd ($n_1$ pieces), $(n_1+1)/2$ will be the middle part. Specifically, when the number of the plurality of insulating sheets 100 is six, third sheet or fourth sheet will be the middle part. When the number of the plurality of insulating sheets 100 is seven, fourth sheet will be the middle part.

As illustrated in FIG. 4, FIG. 6, and FIG. 7, the high thermal conductivity insulating sheets 110 may be disposed in the middle part in the thickness direction of the three or more insulating sheets 100 as well as in the outermost surface(s).

The two or more insulating sheets 100 may also have low permittivity insulating sheets 130, and high permittivity insulating sheets 140, whose permittivity is higher than that of the low permittivity insulating sheets 130.

In a case where three or more insulating sheets 100 are provided, the number of the low permittivity insulating sheets 130 may be larger than that of the high permittivity insulating sheets 140. However, the number of those insulating sheets should not be restricted and the number of the low permittivity insulating sheets 130 may be larger than that of the high permittivity insulating sheets 140.

The permittivity of the high permittivity insulating sheets 140 may be twice or more than twice as large as that of the low permittivity insulating sheets 130.

Figure 8:
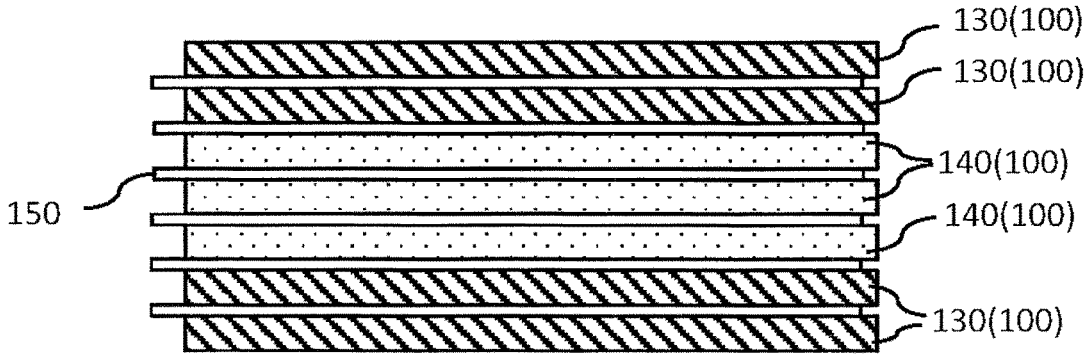
FIG. 8 is a cross sectional side view illustrating an aspect 7 of the coil structure applicable to the first embodiment of the present invention.
Figure 9:
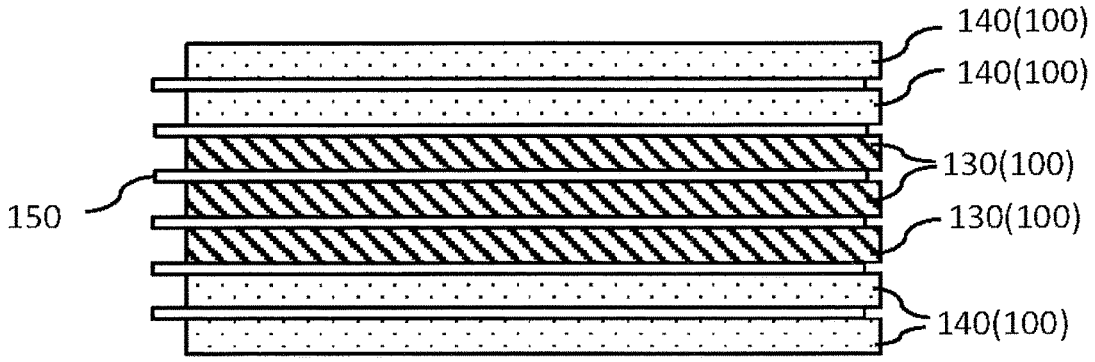
FIG. 9 is a cross sectional side view illustrating an aspect 8 of the coil structure applicable to the first embodiment of the present invention.
Figure 10:
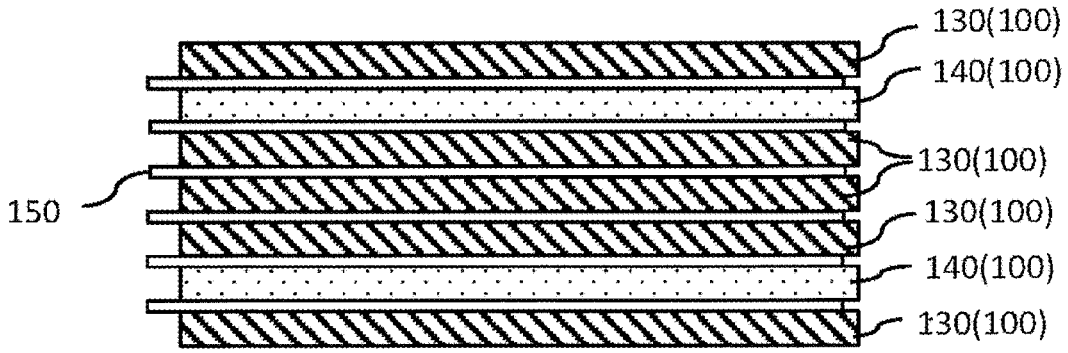
FIG. 10 is a cross sectional side view illustrating an aspect 9 of the coil structure applicable to the first embodiment of the present invention.
Figure 11:
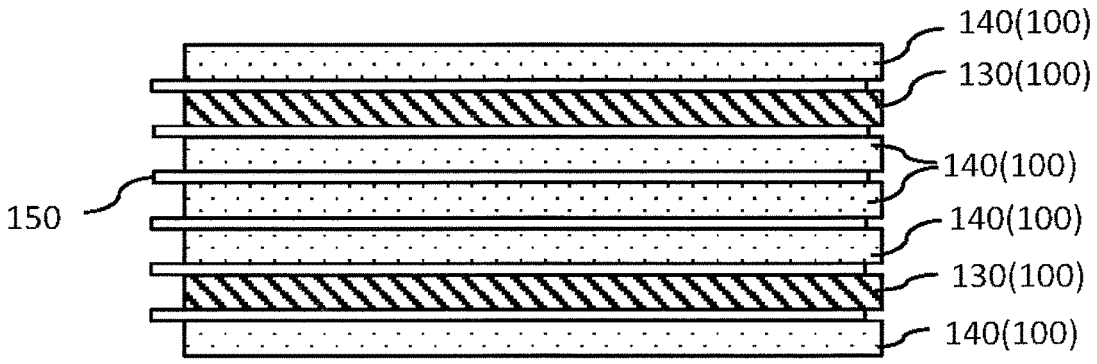
FIG. 11 is a cross sectional side view illustrating an aspect 10 of the coil structure applicable to the first embodiment of the present invention.
Figure 12:
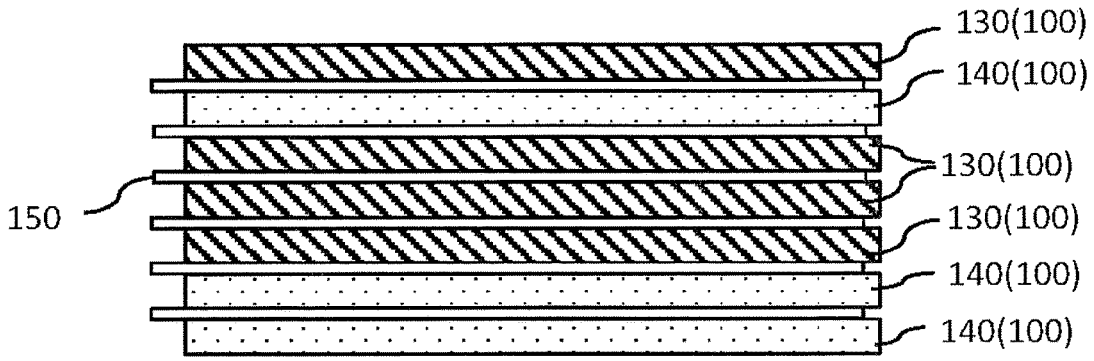
FIG. 12 is a cross sectional side view illustrating an aspect 11 of the coil structure applicable to the first embodiment of the present invention.
Figure 13:
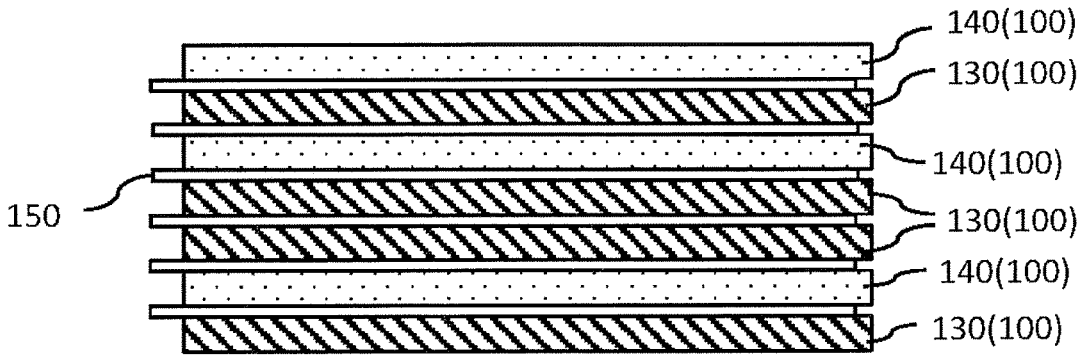
FIG. 13 is a cross sectional side view illustrating an aspect 12 of the coil structure applicable to the first embodiment of the present invention.

As illustrated in FIG. 8 and FIG. 10, the low permittivity insulating sheets 130 may be disposed in outermost surfaces of both ends of the plurality of insulating sheets 100. However, the configuration should not be restricted to such an aspect and the high permittivity insulating sheets 140 may be disposed in the outermost surfaces of the both ends of the plurality of insulating sheets 100 as illustrated in FIG. 9 and FIG. 11. Furthermore, as illustrated in FIG. 12 and FIG. 13, the low permittivity insulating sheets 130 and high permittivity insulating sheets 140 may not be disposed symmetrically with respect to the surface perpendicular to the axial line of the coil 150. For example, a low permittivity insulating sheet 130 may be disposed in the outermost surface of the body 82 side of the core 80, while a high permittivity insulating sheet 140 may be disposed in the outermost surface of the opposing side of the body 82 of the core 80. Alternatively, a high permittivity insulating sheet 140 may be disposed in the outermost surface of the body 82 side of the core 80, while a low permittivity insulating sheet 130 may be disposed in the outermost surface of the opposing side of the body 82 of the core 80.

As illustrated in FIG. 9, FIG. 10, FIG. 12, and FIG. 13, the low permittivity insulating sheets 130 may also be disposed in the middle part in the thickness direction of the three or more insulating sheets 100.

As illustrated in FIG. 10, FIG. 12, and FIG. 13, the low permittivity insulating sheets 130 may be disposed in the middle part in the thickness direction of the three or more insulating sheets 100 as well as in the outermost surface(s).

(Functions and Effects)

Hereinafter, effects obtained from the present embodiment including the abovementioned configuration will be described focusing on those not mentioned yet. It should be noted that an aspect described in "Functions and Effects" is applicable to the abovementioned "Configuration".

According to the present embodiment, as illustrated in FIG. 1 and FIG. 28, the radiators 91, 92 extending toward the radiative insulating sheets 100 are brought into contact with the surfaces of the radiative insulating sheets 100. As a result, it is possible to achieve high radiation effect.

In a case of adopting an aspect in which the high thermal conductivity insulating sheets 110 are disposed in outermost surfaces, heat can be radiated to an outside through the high thermal conductivity insulating sheets 110 and through the radiators 91, 92 so that high radiation properties can be expected. Especially when the high thermal conductivity insulating sheets 110 are brought into contact with the radiators 91, 92, such an effect will be heightened.

In addition, the high thermal conductivity insulating sheets 110 may also be disposed in the middle part in the thickness direction of the plurality of radiative insulating sheets 100. The reason is that the heat generated from the coil 150 can be apt to accumulate in the middle part, but the accumulating heat can be efficiently conducted by adopting the high thermal conductivity insulating sheets 110.

In the present embodiment, the radiators 91, 92 are brought into contact with the radiative insulating sheets 100 so that even when the low thermal conductivity insulating sheets 120 are disposed in the outermost surfaces, the radiation effect can be expected to a certain extent.

Furthermore, in a case of adopting an aspect in which the high thermal conductivity insulating sheets 110 are disposed in a middle part of a thickness direction of a plurality of the radiative insulating sheets 100, and the high thermal conductivity insulating sheets 110 are also disposed in the outermost surfaces and brought into contact with the radiators 91, 92, it is useful in that the heat can be conducted to the radiators 91, 92 from where the heat is apt to accumulate.

Furthermore, in a case of adopting an aspect in which the low thermal conductivity insulating sheets 120 are disposed in outermost surfaces of sides which are brought into contact with the radiators 91, 92 and the high thermal conductivity insulating sheets 110 are disposed in outermost surface of sides which are not brought into contact with the radiators 91, 92, it is useful in that the heat can be radiated to a certain extent from both direction.

In a case of adopting an aspect in which the first radiator 91 extending toward the radiative insulating sheets 100 is brought into contact with the surface of the first radiator side of the radiative insulating sheets 100 and the second radiator 92 extending toward the radiative insulating sheets 100 is brought into contact with the surface of the second radiator 92 side of the radiative insulating sheets 100, it is useful in that the radiation effect can be expected from both the first radiator 91 and second radiator 92. As illustrated in FIG. 1, according to the aspect in which the first projection part 91*a* of the first radiator 91 is brought into contact with the radiative insulating sheet 100 of the first coil structure (primary coil) 10 and the second projection part 92*a* of the second radiator 92 is brought into contact with the radiative insulating sheet 100 of the second coil structure (secondary coil) 20, the radiation effect can be expected with respect to both of the first coil structure (primary coil) 10 and second coil structure (secondary coil) 20. On the other hand, as illustrated in FIG. 28, according to the aspect in which the first projection part 91*a* of the first radiator 91 is brought into contact with one of the radiative insulating sheets 100 of the coil structure 15, and the second projection part 92*a* of the second radiator 92 is brought into contact with the radiative insulating sheet 100 of the coil structure 15, the heat in one coil structure 15 can be expectedly radiated by each of the first radiator 91 and second radiator 92.

In a case of adopting an aspect in which the two or more radiative insulating sheets 100 have the low permittivity insulating sheets 130 and high permittivity insulating sheets 140, and even when adopting high frequency such as MHz or GHz, it is possible to make influences of the high frequency small.

This respect will be hereinafter explained. In a case of adopting high frequency, there is a possibility that the skin effect occurs, so that electric currents flow solely on surfaces. This skin effect further intensifies resistance (for example, a resistance value will be ten times or more), so that the heat will be generated more. Furthermore, in a case of adopting the high frequency, there is a possibility that a dielectric loss tangent becomes large.

The permittivity s will be represented by $\varepsilon=\delta D/\delta E$ (where D is electric flux density, and E is intensity of an electric field). In a case of adopting the plurality of insulating sheets 100, the permittivity thereof will be a sum of the permittivity of each insulating sheets 100. However, when the insulating sheets 100 having low permittivity (a low permittivity insulating sheet 130) are included, the permittivity will be greatly influenced by the insulating sheets 100 having low permittivity. In other words, due to the insulating sheets 100 having low permittivity, it is possible to reduce influences caused by the skin effect when adopting the high frequency and it is possible to prevent the dielectric loss tangent from becoming large.

Therefore, in a case of adopting the aspect in which the two or more insulating sheets 100 have the low permittivity insulating sheets 130, it is possible to reduce the influences caused by the skin effect and to prevent the dielectric loss tangent from becoming large.

In a case of adopting an aspect in which the number of the low permittivity insulating sheets 130 is larger than that of the high permittivity insulating sheets 140, and even when the high frequency is adopted, the low permittivity insulating sheets 130 which is larger in number can surely reduce the influences caused by the skin effect and they can surely prevent the dielectric loss tangent from becoming large. Furthermore, by making the number of the low permittivity insulating sheets 130 large, it is useful in that the capacity of the entire insulating sheets 100 can be made small (it is useful especially when adopting the high frequency).

It should be noted that it is relatively easy to enhance the voltage endurance by thickening each thickness of the radiative insulating sheets 100. Therefore, even when making the number of the high thermal conductivity insulating sheets 110 large or making the number of the low permittivity insulating sheets 130 large, it is possible to prevent the voltage endurance from falling excessively by maintaining total thicknesses of those insulating sheets to a certain extent.

As illustrated in FIG. 14 to FIG. 18, three or more radiative insulating sheets 100 may be provided and the three or more radiative insulating sheets 100 may have first insulating sheet(s) 160, second insulating sheet(s) 170, and third insulating sheet(s) 180. Thermal conductivity of each first insulating sheet 160 may be higher than that of each second insulating sheet 170, and the thermal conductivity of each second insulating sheet 170 is higher than that of each third insulating sheet 180.

A relationship before mentioned between the high thermal conductivity insulating sheets 110 and low thermal conductivity insulating sheets 120 and a relationship before mentioned between the low permittivity insulating sheets 130 and high permittivity insulating sheets 140 are relative. Therefore, for example, it can happen that the low thermal conductivity insulating sheets 120 and high permittivity insulating sheets 140 are identical. Similarly, it can happen that the high thermal conductivity insulating sheets 110 and low permittivity insulating sheets 130 may also be identical. In aspects illustrated in FIG. 14 to FIG. 18, for example, the low thermal conductivity insulating sheets 120 and high permittivity insulating sheets 140 are identically illustrated as third insulating sheets 180, and the high thermal conductivity insulating sheets 110 are used as first insulating sheets 160 and the low permittivity insulating sheets 130 are used as second insulating sheets 170.

Figure 14:
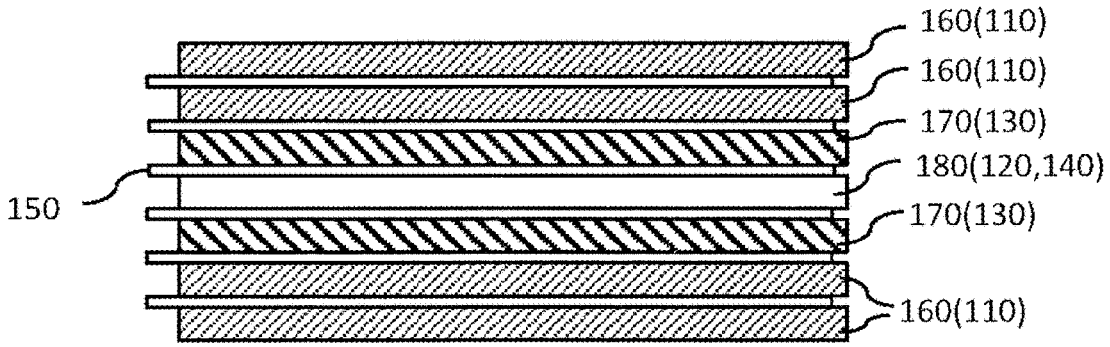
FIG. 14 is a cross sectional side view illustrating an aspect 13 of a coil structure applicable to the first embodiment of the present invention.

As illustrated in FIG. 14, the first insulating sheets 160 may be disposed in outermost surfaces, and the third insulating sheet 180 may be disposed in a middle part of a coil 150, and the second insulating sheets 170 may be disposed between the first insulating sheets 160 and the third insulating sheet 180. In a case of adopting such an aspect, it is useful in that a cooling effect from outside can be given toward the middle part of the coil 150 from the insulating sheets, which are disposed in descending order of the thermal conductivity.

Figure 15:
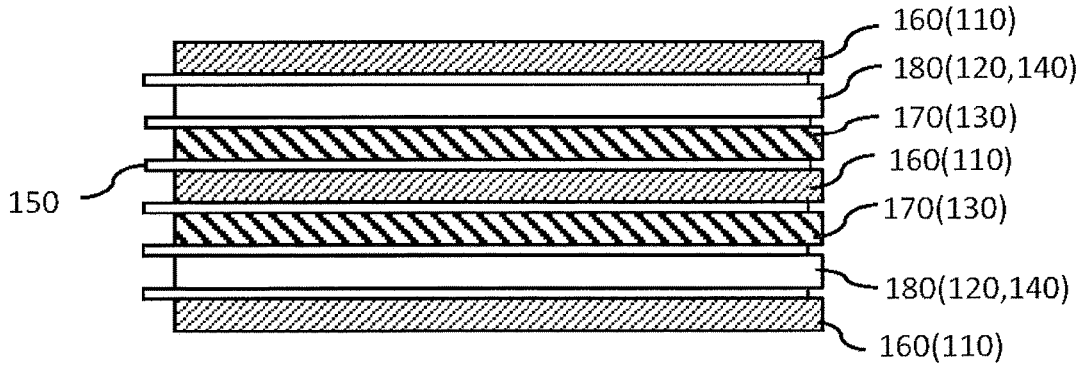
FIG. 15 is a cross sectional side view illustrating an aspect 14 of the coil structure applicable to the first embodiment of the present invention.

As illustrated in FIG. 15, the first insulating sheets 160 may be disposed in the middle part as well as in the outermost surfaces and the second insulating sheets 170 and third insulating sheets 180 may be disposed therebetween. In a case of adopting such an aspect, it is useful in that the cooling effect from outside can be given by the first insulating sheets 160 having high thermal conductivity and the heat from the middle part of the coil 150, where the heat is apt to accumulate, can be conducted by the first insulating sheets 160.

Figure 16:
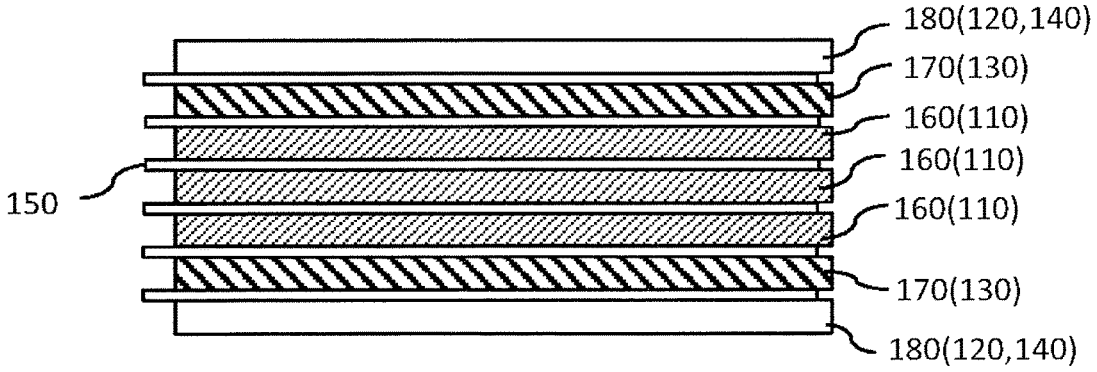
FIG. 16 is a cross sectional side view illustrating an aspect 15 of the coil structure applicable to the first embodiment of the present invention.

As illustrated in FIG. 16, the third insulating sheets 180 may be disposed in the outermost surfaces, and the first insulating sheets 160 may be disposed in the middle part, and the second insulating sheets 170 may be disposed between the first insulating sheets 160 and third insulating sheets 180. In such a case, it is useful in that the heat from the middle part of the coil 150, where the heat is apt to persist, can be efficiently conducted by the first insulating sheets 160.

At least two types of the insulating sheets among the first insulating sheets 160, second insulating sheets 170, and third insulating sheets 180 may have different thicknesses. The thicknesses may be determined based on the permittivity. An insulating sheet 100 having high permittivity may have a thicker thickness and the insulating sheet 100 having low permittivity may have a thinner thickness.

Figure 17:
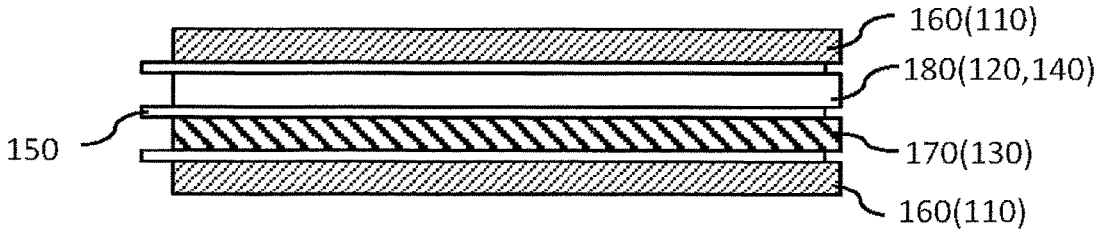
FIG. 17 is a cross sectional side view illustrating an aspect 16 of a coil structure applicable to the first embodiment of the present invention.
Figure 18:
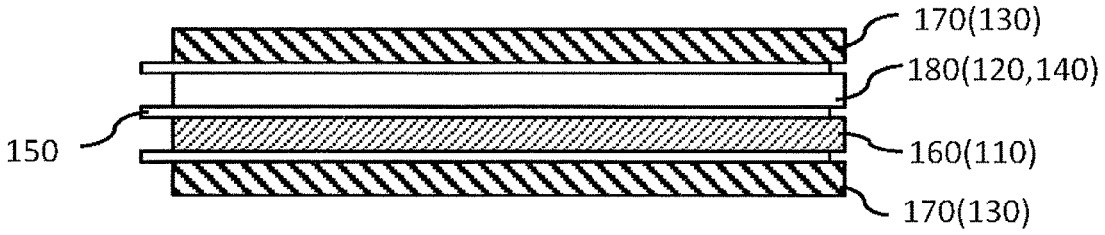
FIG. 18 is a cross sectional side view illustrating an aspect 17 of the coil structure applicable to the first embodiment of the present invention.

The number of the insulating sheets should not be restricted to six or seven, and it may be more or less, two to five, or for example even one hundred. For example, as illustrated in FIG. 17, the first insulating sheets 160 may be provided to both ends of the outermost surfaces and the second insulating sheet 170 and the third insulating sheet 180 may be provided between the both ends. Alternatively, as illustrated in FIG. 18, the second insulating sheets 170 may be provided to the both ends of the outermost surfaces and the first insulating sheet 160 and the third insulating sheet 180 may be provided between the both ends.

Figure 19:
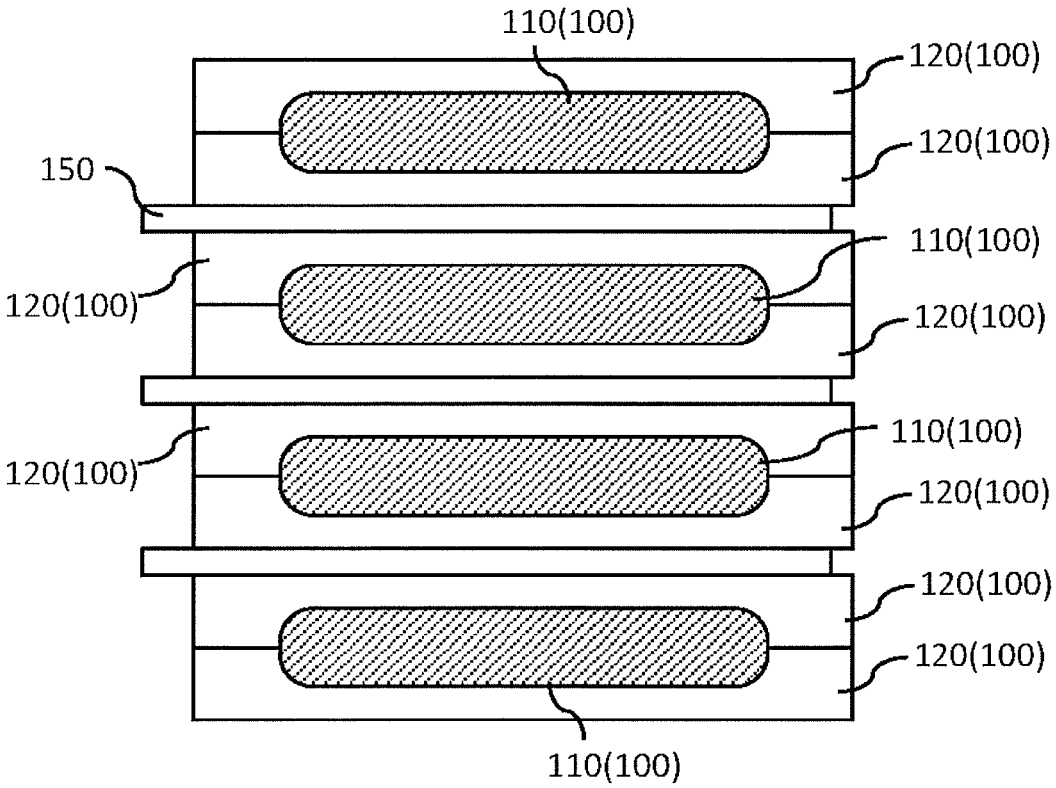
FIG. 19 is a cross sectional side view illustrating an aspect 18 of a coil structure applicable to the first embodiment of the present invention.

The three or more insulating sheets 100 may have two low thermal conductivity insulating sheets 120 and a high thermal conductivity insulating sheet 110, whose thermal conductivity is higher than that of the low thermal conductivity insulating sheets 120. The high thermal conductivity insulating sheet 110 may be provided between the two low thermal conductivity insulating sheets 120 (FIG. 19). A thickness of a peripheral part of the high thermal conductivity insulating sheet 110 may be thinner than a thickness of a central part of the high thermal conductivity insulating sheet 110.

The three or more insulating sheets 100 may also have two high permittivity insulating sheets 140 and a low permittivity insulating sheet 130, whose permittivity is lower than that of the high permittivity insulating sheets 140

Figure 20:
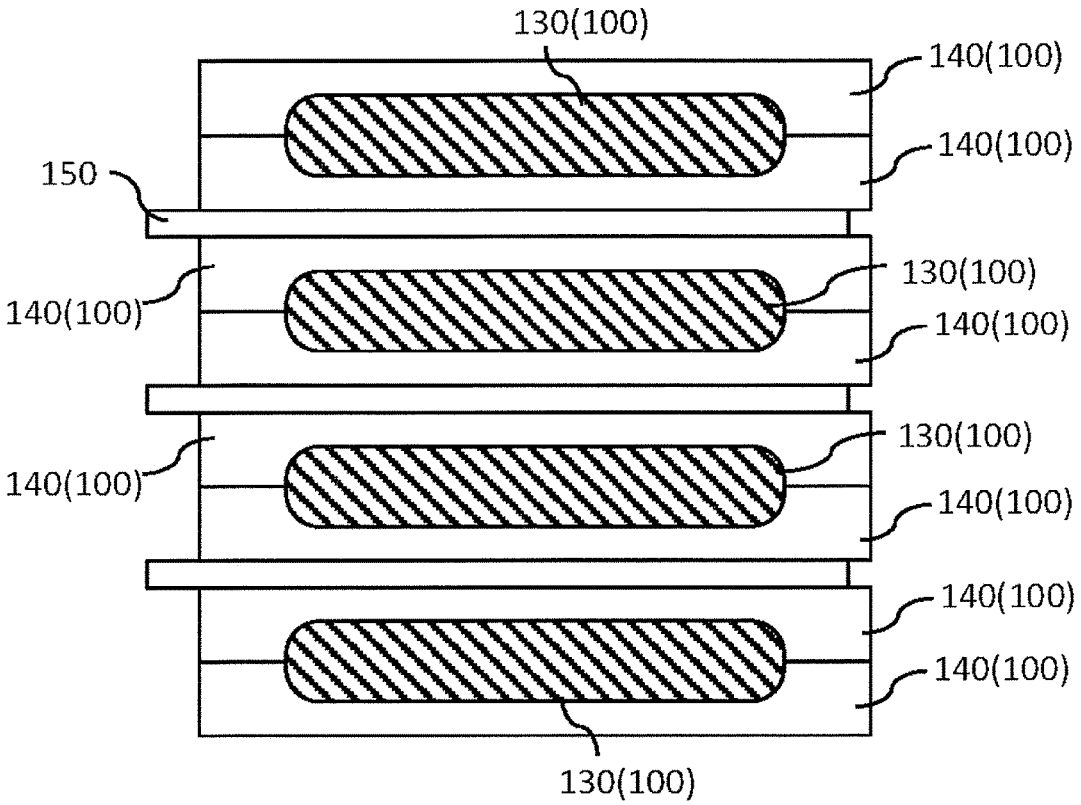
FIG. 20 is a cross sectional side view illustrating an aspect 19 of the coil structure applicable to the first embodiment of the present invention.

(FIG. 20). The low permittivity insulating sheet 130 may be provided between the two high permittivity insulating sheets 140. A thickness of a peripheral part of the low permittivity insulating sheet 130 may be thinner than a thickness of a central part of the low permittivity insulating sheet 130.

An example of the present embodiment has two low thermal conductivity insulating sheets 120 and one high thermal conductivity insulating sheet 110 provided between each of the conductors included in the coil 150, as illustrated in FIG. 19. The thickness of the central part of the high thermal conductivity insulating sheet 110 may be thicker than that of the peripheral part. In an extreme case, the peripheral part may have no high thermal conductivity insulating sheet 110 (thickness may be "zero").

Two high permittivity insulating sheets 140 and one low permittivity insulating sheet 130 may be provided between each of the conductors included in the coil 150, as illustrated in FIG. 20. The thickness of the central part of the low permittivity insulating sheet 130 may be thicker than that of the peripheral part. In an extreme case, the peripheral part may have no low permittivity insulating sheet 130 (thickness may be "zero").

Figure 21:
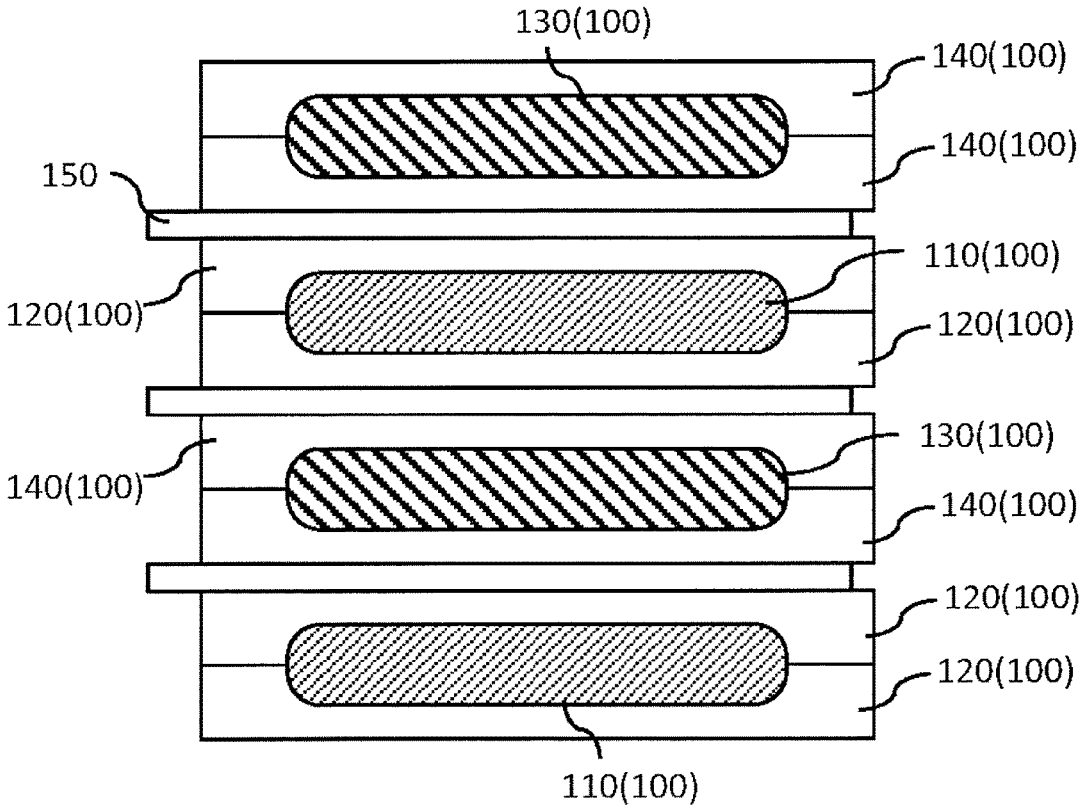
FIG. 21 is a cross sectional side view illustrating an aspect 20 of the coil structure applicable to the first embodiment of the present invention.

Further, two high permittivity insulating sheets 140 and one low permittivity insulating sheet 130, or two low thermal conductivity insulating sheets 120 and one high thermal conductivity insulating sheet 110 may be provided between each of the conductors included in the coil 150, as illustrated in FIG. 21.

From a point of view of standards for safety, beyond a certain distance (for example, 0.4 mm) from the peripheral part, the high thermal conductivity insulating sheet 110 or low permittivity insulating sheet 130 should not be used or the thicknesses thereof may be necessarily made thin. In this respect, according to the aspect illustrated in FIG. 19 to FIG. 21, it is useful in that the standards for safety can be satisfied and that the thermal conduction properties can be enhanced or the permittivity can be made low.

Second Embodiment

Hereinafter, a second embodiment of the present invention will be described.

Figure 22:
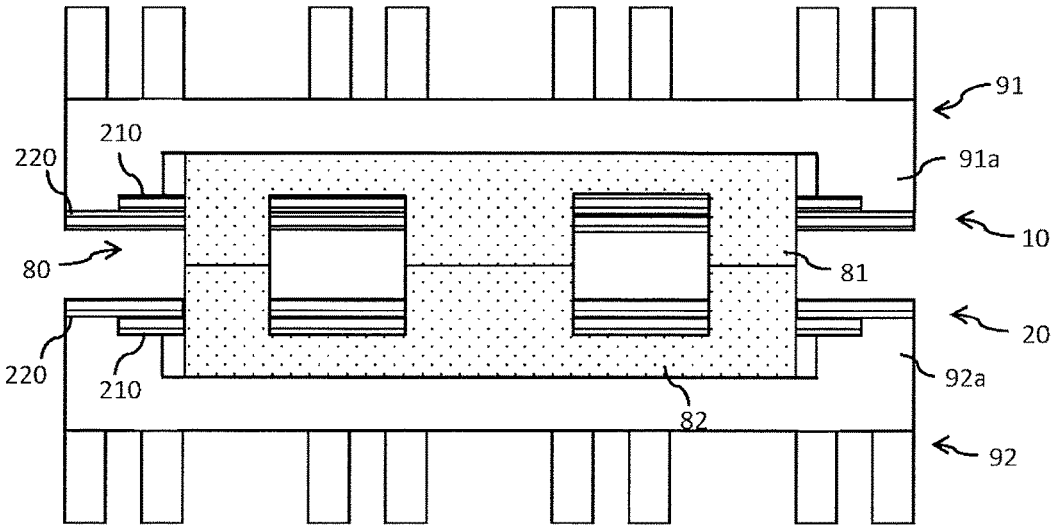
FIG. 22 is a cross sectional side view of a magnetic component according to a second embodiment of the present invention.

As illustrated in FIG. 22, in the present embodiment, two or more radiative insulating sheets 100 have first radiative insulating sheets 210, and second radiative insulating sheets 220 each having an area in a surface direction larger than an area of the first radiative insulating sheet 210. The first radiative insulating sheets 210 are disposed in positions closer to radiators 91, 92 than the second radiative insulating sheets 220, and the radiators 91, 92 are brought into contact with surfaces of the first radiative insulating sheets 210 and second radiative insulating sheets 220.

The area in the surface direction of each second radiative insulating sheet 220 according to the present embodiment is only required to be larger than the area of each first radiative insulating sheet 210, and properties of each second radiative insulating sheet 220 may be similar to or may be different from that of each first radiative insulating sheet 210.

For example, in aspects illustrated in FIG. 2 to FIG. 16, in regard to values of areas in the surface direction of radiative insulating sheets 100 in the 1st to $n_1$th rows ($n_1$ is an integer randomly chosen from 1 to 6) from the top illustrated in FIG. 2 to FIG. 16, supposed that the values of such areas are A1. It is only required that values of areas in the surface direction of radiative insulating sheets 100 in $n_1$th+1 to 7th rows are A2 (A2>A1).

In aspects illustrated in FIG. 17 and FIG. 18, in regard to values of areas in the surface direction of radiative insulating sheets 100 in the 1st to $n_2$th row ($n_2$ is an integer randomly chosen from 1 to 3) from the top illustrated in FIG. 17 and FIG. 18, supposed that the values of such areas are A3. It is only required that values of areas in the surface direction of radiative insulating sheets 100 in $n_1$th+1 to 4th rows are A4 (A4>A3).

In the second embodiment, other configurations are substantially similar to that of the first embodiment.

According to the present embodiment, the radiators 91, 92 can be brought into contact with the surfaces of two radiative insulating sheets 100, that is, the first radiative insulating sheets 210 and second radiative insulating sheets 220. As a result, it is possible to achieve higher radiation effect. It should be noted that the present embodiment is also applicable to an aspect illustrated in FIG. 28.

Third Embodiment

Hereinafter, a third embodiment of the present invention will be described.

Figure 23:
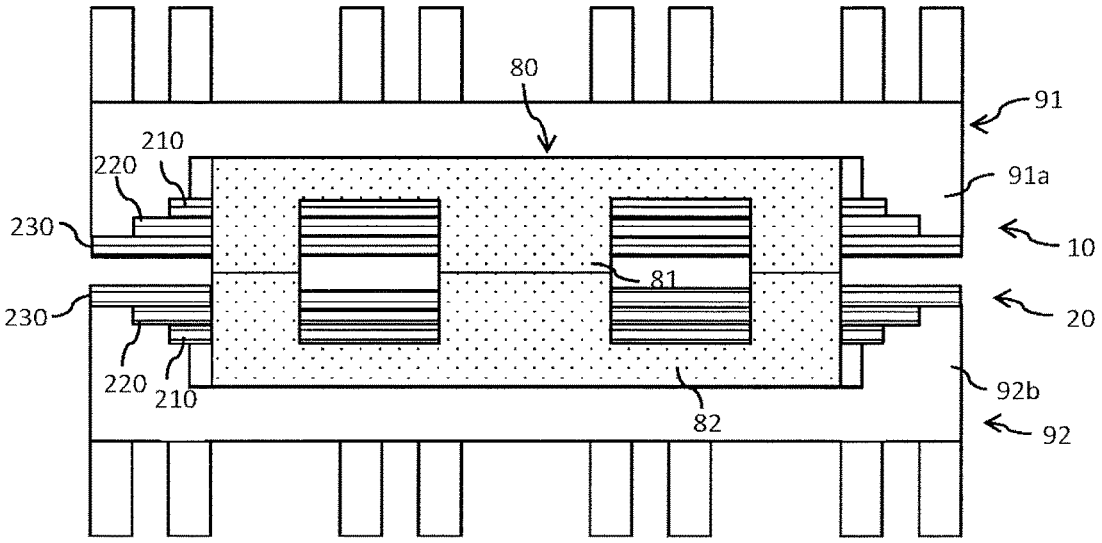
FIG. 23 is a cross sectional side view of a magnetic component according to a third embodiment of the present invention.

As illustrated in FIG. 23, in the present embodiment, three or more radiative insulating sheets 100 are provided. The three or more radiative insulating sheets 100 have first radiative insulating sheets 210, second radiative insulating sheets 220 each having an area in a surface direction larger than an area of the first radiative insulating sheet 210, and third radiative insulating sheets 230 each having an area in the surface direction larger than an area of the second radiative insulating sheet 220. The first radiative insulating sheets 210 are disposed in positions closer to radiators 91, 92 than the second radiative insulating sheets 220 and the second radiative insulating sheets 220 are disposed in positions closer to the radiators 91, 92 than the third radiative insulating sheets 230. The radiators 91, 92 are brought into contact with the first radiative insulating sheets 210, the second radiative insulating sheets 220, and the third radiative insulating sheets 230.

The area in the surface direction of each second radiative insulating sheet 220 according to the present embodiment is only required to be larger than the area of each first radiative insulating sheet 210, and properties of each second radiative insulating sheet 220 may be similar to or may be different from that of each first radiative insulating sheet 210. Furthermore, the area in the surface direction of each third radiative insulating sheet 230 according to the present embodiment is only required to be larger than the area of each second radiative insulating sheet 220, and properties of each third radiative insulating sheet 230 may be similar to or may be different from that of each first radiative insulating sheet 210 and/or that of each second radiative insulating sheet 220.

For example, in the aspects illustrated in FIG. 2 to FIG. 16, in regard to a value of an area in the surface direction of a radiative insulating sheet 100 in $m_1$th row ($m_1$ is an integer randomly chosen from 1 to 5) from the top in FIG. 2 to FIG. 16, supposed that the value of such an area is S1. It is only required that values of areas in the surface direction of radiative insulating sheets 100 in $m_1$+1th to $m_2$th rows ($m_2$ is an integer randomly chosen from $m_1$+1 to 6) are S2 (S2>S1), and values of areas in the surface direction of radiative insulating sheets 100 in $m_2$+1th to 7th rows are S3 (S3>S2).

Furthermore, in the aspects illustrated in FIG. 17 and FIG. 18, in regard to values of areas in the surface direction of the radiative insulating sheets 100 in the 1st to $m_4$th rows ($m_4$ is 1 or 2) from the top of FIG. 17 and FIG. 18, supposed that the values of such areas are S4. It is only required that values of areas in the surface direction of radiative insulating sheets 100 in $m_4$+1th to $m_5$th rows ($m_5$ is an integer randomly chosen from $m_4$+1 to 3) are S5 (S5>A4), and values of areas in the surface direction of radiative insulating sheets 100 in $m_5$+1th to 4th rows are S6 (S6>S5).

In the third embodiment, other configurations are substantially similar to that of the first embodiment.

According to the present embodiment, the radiators 91, 92 can be brought into contact with the surfaces of the three radiative insulating sheets 100, that is, the first radiative insulating sheets 210, second radiative insulating sheets 220, and third radiative insulating sheets 230. As a result, it is possible to achieve even higher radiation effect. It should be noted that the present embodiment is also applicable to an aspect illustrated in FIG. 28.

Fourth Embodiment

Hereinafter, a fourth embodiment of the present invention will be described.

In the present embodiment, a size of each radiative insulating sheet 100 is different. Areas in a surface direction of radiative insulating sheets 100 disposed in sides opposing to radiators 91, 92 are larger than areas of radiative insulating sheets 100 disposed in sides of the radiators 91, 92. The radiators 91, 92 are brought into contact with a surface of each radiative insulating sheet 100.

For example, in aspects illustrated from FIG. 2 to FIG. 16, the areas in the surface direction of the radiative insulating sheets 100 may be made larger as going downward from the top of FIG. 2 to FIG. 16. In aspects illustrated in FIG. 17 and FIG. 18, the areas in the surface direction of the radiative insulating sheets 100 may be made larger as going downward from the top of FIG. 17 and FIG. 18. Even in aspects illustrated in FIGS. 19 to 21, the areas in the surface direction of the radiative insulating sheets 100 may be made larger as going downward from the top of FIG. 19 to FIG. 2.

Figure 24:
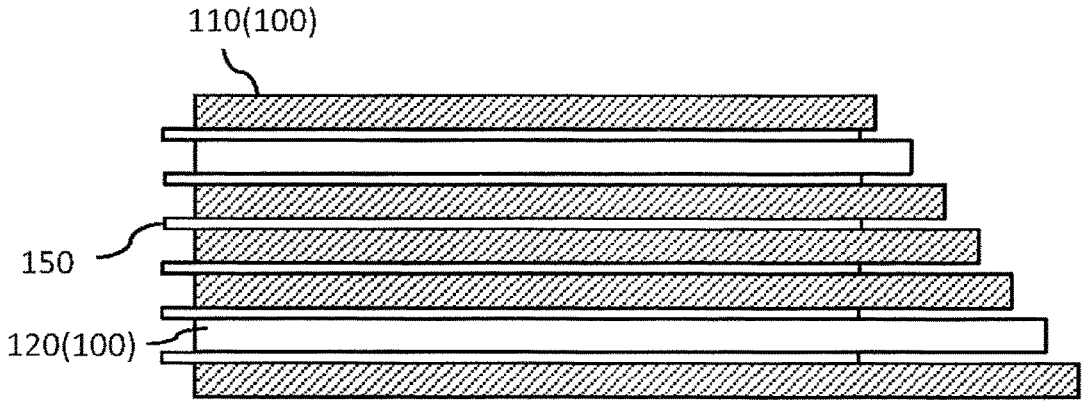
FIG. 24 is a cross sectional side view illustrating an aspect 1 of a coil structure applicable to a fourth embodiment of the present invention.
Figure 25:
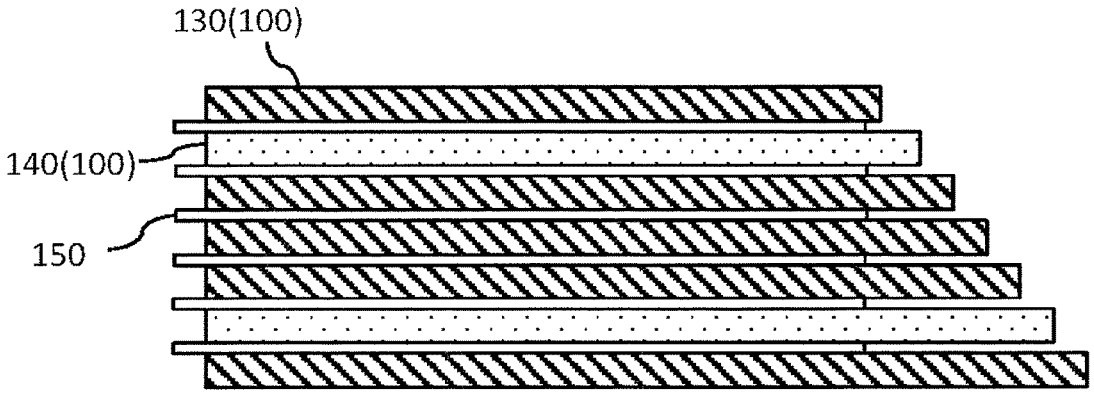
FIG. 25 is a cross sectional side view illustrating an aspect 2 of the coil structure applicable to the fourth embodiment of the present invention.
Figure 26:
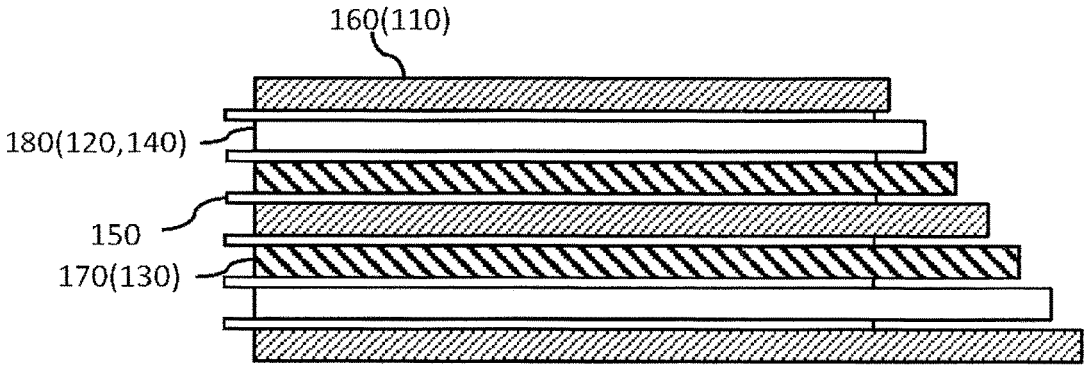
FIG. 26 is a cross sectional side view illustrating an aspect 3 of the coil structure applicable to the fourth embodiment of the present invention.
Figure 27:
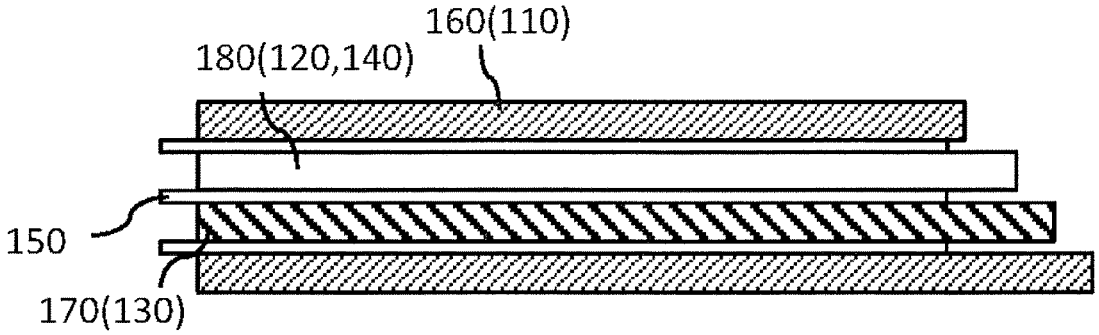
FIG. 27 is a cross sectional side view illustrating an aspect 4 of the coil structure applicable to the fourth embodiment of the present invention.

An aspect illustrated in FIG. 24 can be achieved by modifying an aspect illustrated in FIG. 4 according to the first embodiment for the aspect according to the present embodiment. An aspect illustrated in FIG. 25 can be achieved by modifying an aspect illustrated in FIG. 10 according to the first embodiment for the aspect according to the present embodiment. An aspect illustrated in FIG. 26 can be achieved by modifying an aspect illustrated in FIG. 15 according to the first embodiment for the aspect according to the present embodiment. An aspect illustrated in FIG. 27 can be achieved by modifying an aspect illustrated in FIG. 17 according to the first embodiment for the aspect according to the present embodiment.

According to the present embodiment, the radiators 91, 92 can be brought into contact with the surface of each radiative insulating sheet 100. As a result, it is possible to achieve further even higher radiation effect.

It should be noted that the present embodiment is also applicable to an aspect illustrated in FIG. 28. In such a case, as illustrated in FIG. 24 to FIG. 27, the areas in the surface direction of the radiative insulating sheets 100 may be made larger as going downward from the top of FIG. 2 to FIG. 21. The areas in the surface direction of the radiative insulating sheets 100 may be made larger as going toward a middle part from the side of the first radiator 91, and similarly, the areas in the surface direction of the radiative insulating sheets 100 may be made larger as going toward the middle part from the side of the second radiator 92 so that the radiators 91, 92 may be brought into contact with the surface of each radiative insulating sheet 100.

Description of each of the abovementioned embodiments and disclosure of the drawings are for exemplary purposes so as to illustrate the present invention described in the claims. The present invention described in the claims should not be restricted to the description of each of the abovementioned embodiments or the disclosure of the drawings.

REFERENCE SIGNS LIST

80 CORE
91 FIRST RADIATOR (RADIATOR)
92 SECOND RADIATOR (RADIATOR)
110 HIGH THERMAL CONDUCTIVITY INSULATING SHEET (INSULATING SHEET)
120 LOW THERMAL CONDUCTIVITY INSULATING SHEET (INSULATING SHEET)
130 LOW PERMITTIVITY INSULATING SHEET (INSULATING SHEET)
140 HIGH PERMITTIVITY INSULATING SHEET (INSULATING SHEET)
150 COIL
160 FIRST INSULATING SHEET (INSULATING SHEET)
170 SECOND INSULATING SHEET (INSULATING SHEET)
180 THIRD INSULATING SHEET (INSULATING SHEET)
210 FIRST RADIATIVE INSULATING SHEET
220 SECOND RADIATIVE INSULATING SHEET
230 THIRD RADIATIVE INSULATING SHEET

What is claimed is:

1. A magnetic component comprising:

a core provided with a leg;

wherein a coil structure having a coil including conductors wrapped around the leg, and two or more radiative insulating sheets provided between the conductors; and wherein a radiator brought into contact with an end surface of the core, and extending toward the radiative insulating sheets and brought into contact with the surface of the radiative insulating sheets;

wherein the two or more radiative insulating sheets have a first radiative insulating sheet, and a second radiative insulating sheet having an area in a surface direction larger than an area of the first radiative insulating sheet, wherein the first radiative insulating sheet is disposed in a position closer to the radiator than the second radiative insulating sheet, and wherein the radiator is brought into contact with the surfaces of the first radiative insulating sheet and the second radiative insulating sheet.

2. The magnetic component according to claim 1, wherein the radiative insulating sheets have a third radiative insulating sheet having an area in the surface direction larger than the area of the second radiative insulating sheet, wherein the second radiative insulating sheet is disposed in a position closer to the radiator than the third radiative insulating sheet, and wherein the radiator is brought into contact with the surfaces of the first radiative insulating sheet, the second radiative insulating sheet and the third radiative insulating sheet.

3. The magnetic component according to claim 1, wherein the two or more radiative insulating sheets have low conductivity insulating sheet and high conductivity insulating sheet, whose conductivity is higher than conductivity of the low conductivity insulating sheet, and wherein at least a surface of the high conductivity insulating sheet is brought into contact with the radiator.

4. The magnetic component according to claim 1, wherein the radiator has a first radiator brought into contact with a first end surface of the core and a second radiator brought into contact with a second end surface of the core, wherein the first radiator extends toward the radiative insulating sheet and is brought into contact with a surface of a first radiator side of the radiative insulating sheets, and wherein the second radiator extends toward the radiative insulating sheet and is brought into contact with a surface of a second radiator side of the radiative insulating sheet.

5. The magnetic component according to claim 1, wherein the coil structure has a first coil structure and a second coil structure provided separately from the first coil structure, wherein each of the first coil structure and the second coil structure has the coil and two or more radiative insulating sheets, wherein the radiator has a first radiator brought into contact with a first end surface of the core and a second radiator brought into contact with a second end surface of the core, wherein the first radiator extends toward the radiative insulating sheet of the first coil structure and is brought into contact with a surface of a first radiator side of this radiative insulating sheets, and wherein the second radiator extends toward the radiative insulating sheet of the second coil structure and is brought into contact with a surface of a second radiator side of this radiative insulating sheet.

* * * * *